United States Patent [19]

Mito

[11] 4,287,626

[45] Sep. 8, 1981

[54] FLEXIBLE ANCHOR BUOY

[75] Inventor: Jun Mito, Hiratsuka, Japan

[73] Assignee: The Yokohama Rubber Co., Ltd., Japan

[21] Appl. No.: 11,563

[22] Filed: Feb. 12, 1979

[51] Int. Cl.[3] ..... B63B 21/52

[52] U.S. Cl. ..... 9/8 R

[58] Field of Search ..... 9/8 R, 8.3 R, 8.3 E, 9/9; 114/179, 210, 219, 220, 230, 234, 293, 310

[56] References Cited

U.S. PATENT DOCUMENTS

| | | | |
|---|---|---|---|
| 512,957 | 1/1894 | Guest et al. | 9/8.3 R |
| 1,781,403 | 11/1930 | Lyons | 114/220 |
| 3,077,614 | 2/1963 | Lloyd | 114/230 |
| 3,528,383 | 3/1968 | Fetters | 114/220 |
| 3,950,806 | 4/1976 | Puchois | 114/230 |

FOREIGN PATENT DOCUMENTS

| | | | |
|---|---|---|---|
| 613647 | 12/1948 | United Kingdom | 9/8 R |
| 904307 | 8/1962 | United Kingdom | 114/220 |

*Primary Examiner*—Trygve M. Blix
*Assistant Examiner*—Jesus D. Sotelo
*Attorney, Agent, or Firm*—Robert E. Burns; Emmanuel J. Lobato; Bruce L. Adams

[57] ABSTRACT

A flexible anchor buoy includes a tube for the passage therethrough of an anchor chain, a core pipe fixed perpendicularly to the tube, and a pair of resilient buoyant bodies disposed around the core pipe one on each side of the tube and separated from the tube. The resilient buoyant bodies are enclosed by a pair of flexible coverings, respectively. When the anchor buoy is held against a ship and locally compressed under the weight of an anchor, the buoyant bodies flex relatively freely without being stressed by the tube.

10 Claims, 6 Drawing Figures

FLEXIBLE ANCHOR BUOY

BACKGROUND OF THE INVENTION

1. Field of the Invention

The present invention relates to a flexible buoy especially for connection to an anchor.

2. Prior Art

Flexible anchor buoys have been devised to provide resilient cushioning against permanent deformations and damages that iron anchor buoys conventionally caused to themselves and ships while anchors are being pulled up. A flexible anchor buoy typically comprises a tube for an anchor chain to pass therethrough, a core connected to the tube, and a resilient buoyant member including a buoyant body and a covering enclosing the buoyant body, the resilient buoyant member being disposed around and bonded to both the chain tube and the core. While the anchor is being lifted from the sea, the buoy is held against the ship and is compressed at localized positions under the weight of the anchor as shown in FIG. 5 of the accompanying drawings. The buoy as thus carried by the ship on its way to another place is further subjected to sudden compressive forces when the ship is rolled by waves or changes its sailing speed. This has led to a disadvantage in that the resilient buoyant member, particularly the covering, tends to be ripped off the chain tube due to shearing stresses applied to a region near the chain tube.

SUMMARY OF THE INVENTION

A flexible anchor buoy includes resilient buoyant means mounted on an elongate core and separated from a tube connected to and extending substantially perpendicularly to the core for the passage therethrough of a chain connected to an anchor. The resilient buoyant means comprises a pair of resilient buoyant bodies attached to and disposed around the core one on each side of the chain tube, and a pair of flexible coverings enclosing the pair of resilient buoyant bodies, respectively, and bonded to the core. Since the resilient buoyant bodies are separated from the chain tubes, they can flex freely under forces exerted and are free from breakages that could take place if they were bonded to the chain tube.

It is an object of the present invention to provide a flexible anchor buoy having resilient buoyant means which is free from being damaged even when the buoy is compressed against a ship under the weight of an anchor.

It is another object of the present invention to provide a flexible anchor buoy having resilient buoyant means rotatably removably and fitted on a core extending transversely to a tube for the passage therethrough of an anchor chain.

The above other objects and advantages of the present invention will become apparent from the following description when taken in conjunction with the accompanying drawings which illustrate preferred embodiments by way of example.

DETAILED DESCRIPTION

Figure 1:
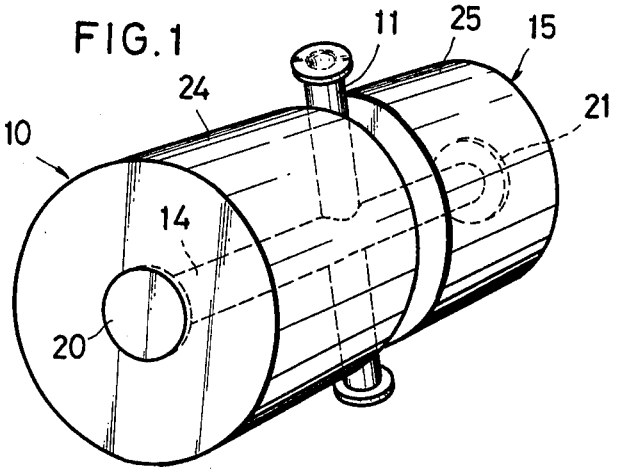
FIG. 1 is a perspective view of a flexible anchor buoy constructed in accordance with the present invention.
Figure 2:
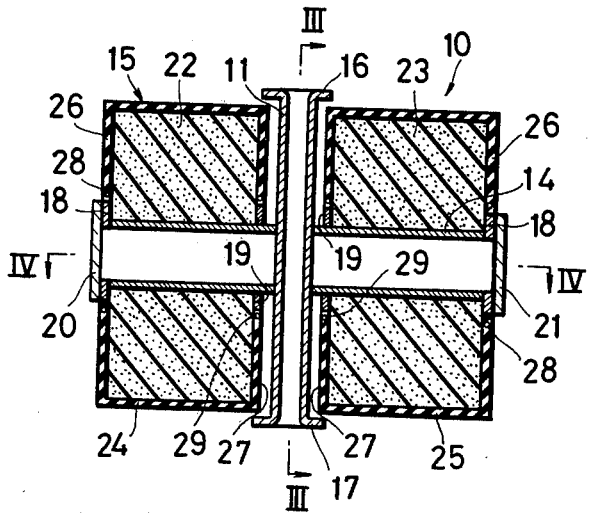
FIG. 2 is a longitudinal cross-sectional view of the flexible anchor buoy.
Figure 3:
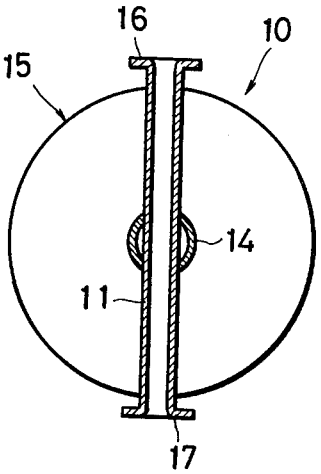
FIG. 3 is a cross-sectional view taken along line III—III of FIG. 2.
Figure 4:
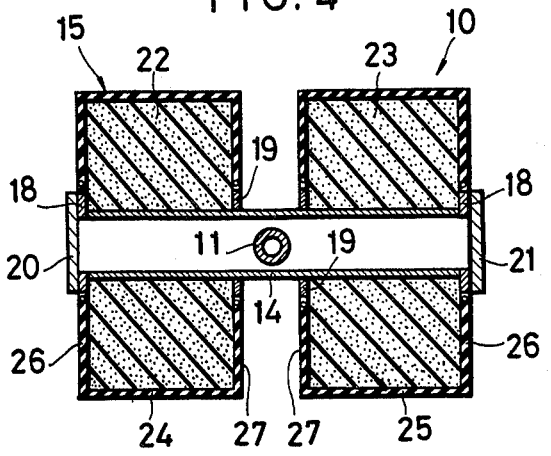
FIG. 4 is a cross-sectional view taken along line IV—IV of FIG. 2.

As shown in FIGS. 1 through 4, a flexible anchor buoy 10 generally comprises a tube 11 made of steel for the passage therethrough of a chain 12 (FIG. 5) connected to an anchor 13, an elongated core 14 in the form of a pipe of steel extending substantially perpendicularly to the tube 11, and resilient buoyant means 15 mounted on the core 14. The tube 11 has a pair of end flanges 16,17 with their inner peripheral edges rounded for facilitating the movement of the chain 12 into and out of the tube 11.

The tube 11 has a smaller diameter than the core pipe 14 and extends through the core pipe 14 at a position that is substantially centrally located of the core. The core 14 is connected as by welding to the tube 11 at a substantially central position between the end flanges 16,17. Mounted on the core pipe 14 are two pairs of annular flanges 18,19, one of the annular flanges 18 in each pair being fixed to an end of the core pipe 14 and the other annular flange 19 being disposed therearound adjacent to the tube 11. The core pipe 14 is closed off at its ends by a pair of circular plates 20,21 each having a diameter larger than that of the core pipe 14 and fixed as by welding to the annular flanges 18,18. The resilient buoyant means 15 comprises a pair of resilient buoyant bodies 22,23 made of polymer foam such as polyethylene foam and a pair of flexible coverings 24,25 made of rubber or urethane and enclosing the buoyant bodies 22,23, respectively. Each buoyant body 22, 23 is in the form of a centrally apertured cylinder mounted around and bonded to the core pipe 14. Each covering 24,25 is shaped as a hollow cylinder that fits over corresponding one of the buoyant bodies 22,23. The buoyant bodies 22,23 are located one on each side of and separated from the tube 11.

Each covering 24,25 has a pair of central openings in its end walls 26,27, the openings being bounded by a pair of circular edges that are bonded respectively to the peripheral surfaces of the annular flanges 18,19 on the core pipe 14. A pair of wire rings 28,29 are embedded in each of the coverings 24,25 and extend around the openings for reinforcing the circular edges bonded to the core pipe 14.

Figure 5:
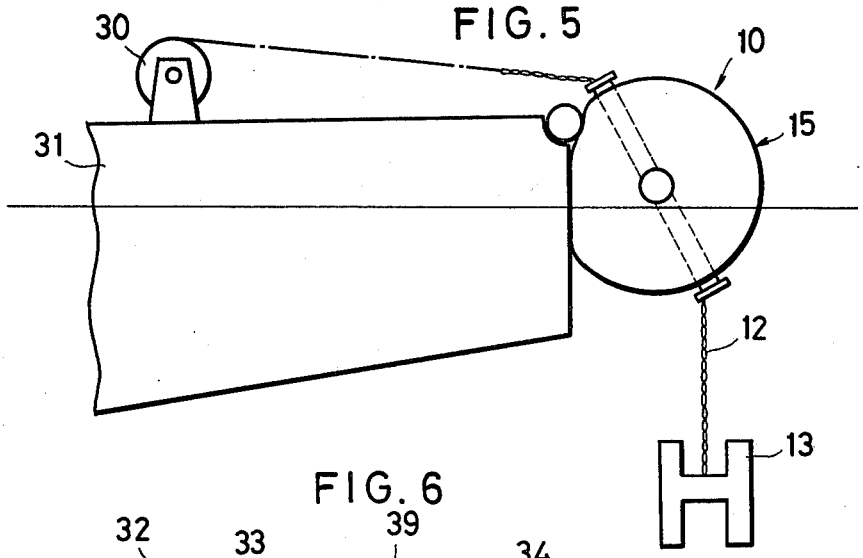
FIG. 5 is a fragmentary elevational view of the anchor buoy as held against a side of a ship while pulling up an anchor.

When the anchor 13 is pulled up by a winch 30 on a ship 31 as shown in FIG. 5, the anchor buoy 10 is held against a side of the ship 31 and locally compressed under the weight of the anchor 13. Since the buoyant bodies 22,23 are not directly joined to the tube 11, they can flex relatively freely without being stressed by the tube 11. Accordingly, the buoyant bodies 22,23 are prevented from being ruptured under compressive forces imposed thereon. The coverings 24,25 remain strongly bonded to the annular flanges 18,19 since the reinforcement rings 28,29 act to distribute or weaken stresses applied to the end walls 26,27 of the coverings 24,25.

Figure 6:
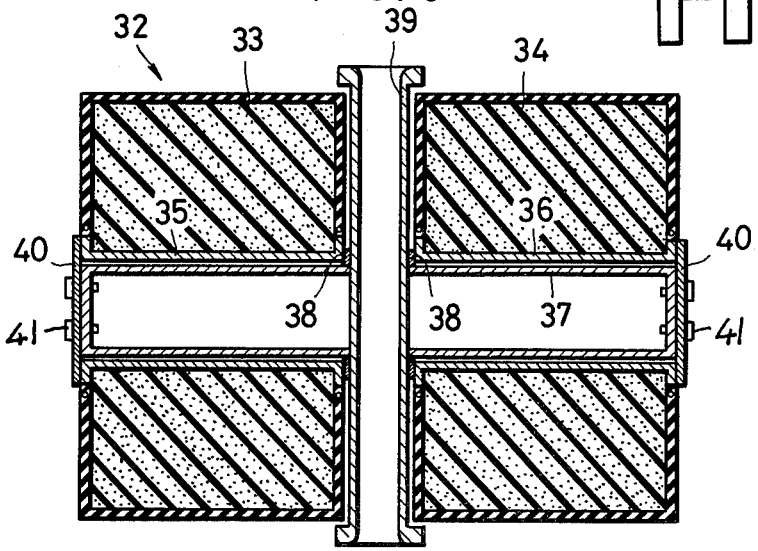
FIG. 6 is an enlarged longitudinal cross-sectional view of a flexible anchor buoy according to another embodiment.

FIG. 6 illustrates another embodiment in which a flexible anchor buoy 32 has a pair of resilient buoyant bodies 33,34 disposed around and bonded to a pair of tubular members 35,36, respectively, rotatably fitted over an elongate core 37. Each tubular member 35,36 is placed against axial displacement between a retainer ring 38 disposed around the core 37 and adjacent to a chain tube 39 and an end flange 40 fixed by bolts 41 to an end of the core 37. With the structure of FIG. 6, the buoyant bodies 33,34 can rotate about the core 37 and the anchor buoy 32 can move smoothly on a side of a ship when the anchor is lifted or allowed down. Moreover, the bolts 41 holding the flanges 40 can be unscrewed to permit removal of the buoyant bodies 33,34 for replacement.

Although some preferred embodiments have been shown and described in detail, it should be understood that various changes and modifications may be made therein without departing from the scope of the appended claims.

What is claimed is:

1. A flexible anchor buoy comprising:

a tube for the passage therethrough of a chain connected to an anchor, an elongate core means fixed at a substantially central position thereof to said tube and extending substantially perpendicularly to said tube, and a pair of thick resilient buoyant bodies mounted on and around said elongate core means at opposite sides respectively of said tube and extending substantially from said tube to the respective ends of said elongate core means, said buoyant bodies having axial bores to receive said elongate core means to mount said buoyant bodies on said core means and being separated from said tube for flexing independently of said tube.

2. A flexible anchor buoy according to claim 1, in which each of said resilient buoyant bodies is bonded to said elongate core means, and in which a flexible covering encloses each of said resilient buoyant bodies and is bonded to said elongate core means.

3. A flexible anchor buoy according to claim 2, in which said buoyant body is in the form of a cylinder, said core means having a pair of annular flanges disposed therearound, and said covering having a pair of edge surfaces bonded to the peripheral surfaces of said annular flanges, there being a pair of wire rings embedded in said covering along said edge surfaces.

4. A flexible anchor buoy according to claim 1, in which each of said resilient buoyant bodies comprises a tubular member removably fitted over said elongate core means, said resilient buoyant body being bonded to and disposed around said tubular member, and a flexible covering enclosing said resilient buoyant body and bonded to said tubular member.

5. A flexible anchor buoy according to claim 4, further including a retainer ring disposed around said elongate core means and a flange mounted on an end of said elongate core means, said tubular member being held between said retainer ring and said flange against axial displacement relative to said elongate core means.

6. A flexible anchor buoy according to claim 2 or 4, in which said buoyant body is made of polyethylene foam and said covering is of rubber or urethane.

7. A flexible anchor buoy according to claim 1, in which said elongate core means (is) and said resilient buoyant bodies are of circular cross section and said resilient buoyant (means) bodies are rotatable on said core means.

8. A flexible anchor buoy according to claim 1, in which means is provided for removably retaining said buoyant bodies on said core means.

9. A flexible anchor buoy according to claim 1, in which said core means is tubular with a larger diameter than said tube, and in which said tube extends through a transverse hole in said tubular core means.

10. A flexible anchor buoy according to claim 1, in which said resilient buoyant bodies are generally cylindrical, and in which said tube terminates in flanged ends beyond the peripheries of said generally cylindrical bodies.

* * * * *